US005474162A

United States Patent [19]

Shyr et al.

[11] Patent Number: 5,474,162

[45] Date of Patent: Dec. 12, 1995

[54] PARTITIONABLE TRAVELING BAG WITH EXTENDABLE HANDLE

[76] Inventors: Michael H. Shyr; Godfrey S. Shyr, both of 2250 Nadula Dr., Hacienda Heights, Calif. 91745

[21] Appl. No.: 166,070

[22] Filed: Dec. 13, 1993

[51] Int. Cl.[6] ..... A45C 5/14; A45C 13/04; A45C 13/10; A45C 13/26

[52] U.S. Cl. ..... 190/18 A; 190/39; 190/109; 190/111; 190/115; 190/122; 190/127; 206/289; 206/292; 280/37

[58] Field of Search ..... 280/47.29, 47.31, 280/37, 655.1; 206/289, 292; 190/18 A, 115, 117, 109, 107, 111, 112, 24, 119, 127, 122

[56] References Cited

U.S. PATENT DOCUMENTS

| | | | |
|---|---|---|---|
| 2,131,583 | 9/1938 | Crotty et al. | 190/111 X |
| 2,244,091 | 6/1941 | Wein | 190/109 X |
| 2,918,997 | 12/1959 | Kotkins | 190/111 X |
| 3,592,314 | 7/1971 | Jacobson | 190/122 X |
| 3,977,501 | 8/1976 | Alonso | 190/119 X |
| 4,729,460 | 3/1988 | Kim | 190/109 |
| 4,825,985 | 5/1989 | Kim | 190/111 |
| 4,925,021 | 5/1990 | Pulichino, Jr. | 190/109 X |
| 4,995,487 | 2/1991 | Plath | 190/18 A |
| 5,054,589 | 10/1991 | Bomes et al. | 190/111 X |
| 5,105,920 | 4/1992 | Grebenstein | 190/122 X |
| 5,108,119 | 4/1992 | Huang | 190/18 A |
| 5,167,306 | 12/1992 | Carrigan, Jr. | 190/18 A |
| 5,197,580 | 3/1993 | Berman et al. | 190/18 A X |

FOREIGN PATENT DOCUMENTS

| | | | |
|---|---|---|---|
| 989498 | 9/1951 | France | 190/109 |

*Primary Examiner*—Sue A. Weaver
*Attorney, Agent, or Firm*—Price, Gess & Ubell

[57] ABSTRACT

The partitionable traveling bag includes a support wall, an external covering including a body portion and a lid portion, a perimeter support band, and a partition material secured within the body portion between the support wall and the perimeter support band. The partition material spans across the traveling bag's body portion partitioning the traveling bag into front and rear compartments, while simultaneously providing structural support to the traveling bag. The partition material includes a zippered flap portion providing access to the rear compartment without having to detach the partition material from the body portion of the traveling bag. The partitionable traveling bag additionally includes a base plate, at least two wheel assemblies attached to the base plate, and an extendable handle assembly attached to the base plate and extending through the rear compartment of the traveling bag.

15 Claims, 5 Drawing Sheets

PARTITIONABLE TRAVELING BAG WITH EXTENDABLE HANDLE

BACKGROUND OF THE INVENTION

1. Field of the Invention

The present invention relates to a partitionable traveling bag with extendable handle and, more particularly, to a traveling bag that includes a partition material dividing the bag into respective front and rear compartments, the partition material additionally providing structural support to the bag.

2. Description of Related Art

The traveling bag art is generally cognizant of luggage with multiple compartments and of luggage including extendable handles. Although a variety of traveling bags exist, the art is still without a traveling bag that is easily manufactured, inexpensive, portable, and partitionable into front and rear compartments via a partition material which provides both structural support to the traveling bag and access to the rear compartment.

OBJECTS AND SUMMARY OF THE INVENTION

An object of the present invention is to provide a traveling bag that is partitionable into front and rear compartments, the traveling bag including a partition material which provides access to the rear compartment while simultaneously providing structural support to the traveling bag.

Another object is to provide a partitionable traveling bag that includes an extendable handle assembly.

Still another object is to provide a traveling bag that is easily and inexpensively manufactured from relatively few materials.

The partitionable traveling bag includes a support wall, an external covering including a body portion and a lid portion, a perimeter support band, and a partition material secured within the body portion between the support wall and the perimeter support band. The partition material spans across the traveling bag's interior, partitioning the traveling bag into front and rear compartments, while additionally providing structural support to the traveling bag. The partition material includes a zippered flap portion providing access to the rear compartment without detaching the partition material from the body portion of the traveling bag.

A more elaborate embodiment of the partitionable traveling bag further includes a base plate, at least two wheel assemblies attached to the base plate, and an extendable handle assembly attached to the base plate and extending through the rear compartment of the traveling bag.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a partitionable traveling bag with extendable handle.

Figure 1:
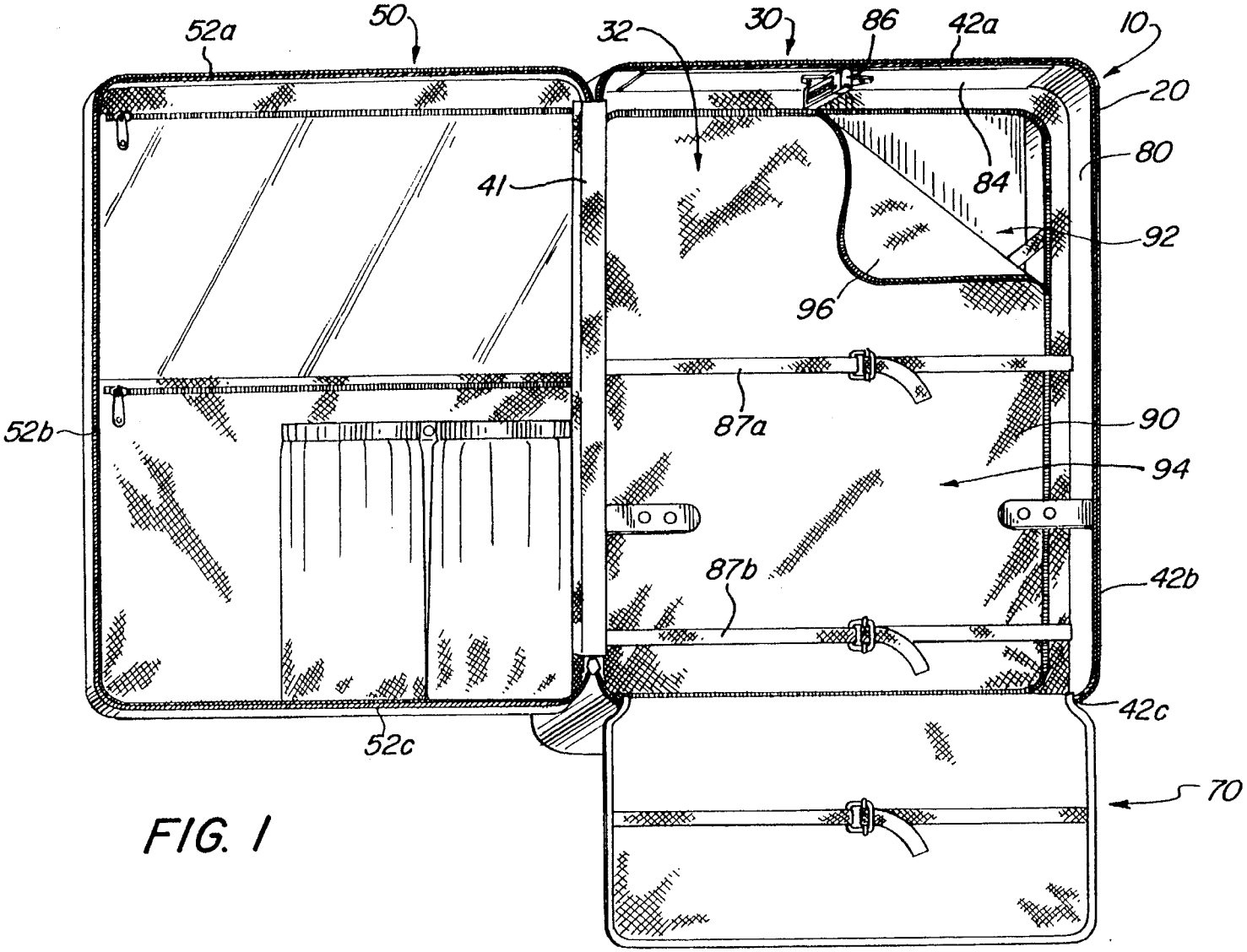
FIG. 1 is a front perspective view of the traveling bag in an open position.

FIG. 1 is a front view of a traveling bag 10 in an opened position. Traveling bag 10 includes an external covering 20 which is preferably manufactured from a flexible material such as 600D polytex with PVC backing. Other suitable materials include, but are not limited to, canvas, cloth, leather, and nylon. The external covering 20 may be, but is not necessarily, divided into three portions: a body portion 30, a lid portion 50, and a gate portion 70. The space within the body portion 30 generally defines a traveling bag compartment 32.

The typical piece of luggage often embodies design compromises. Fixed partitions are rarely included in a traveling bag when a maximum amount of packing space and flexibility are desired characteristics. As most seasoned travelers know, garments (such as suits, blouses, etc.) are preferably segregated from other travel articles to prevent damage, wrinkles, and the like. Such valuable garments are often transported in a "garment bag" which is invariably partitioned for this purpose. Unfortunately, most "garment bags" are cumbersome to transport, lack sufficient packing space, and, in reality, provide very little protection to the garments contained therein because of a decided absence of rigid structural support around the garments. In summary, known "garment bags" do not provide the structural stability and transportability of a suitcase.

The traveling bag 10 addresses these concerns by additionally providing a support wall 80, which is preferably made from a semirigid plastic material, and a partition 90, separating the traveling bag compartment 32 into a rear compartment 92 and a front compartment 94. Partition 90 serves several purposes. First, partition 90 protects expensive garments which are stored in the front compartment 94 from the traveler's other personal articles which are first packed within the rear compartment 92. Second, partition 90 is tautly drawn across the traveling bag compartment 32 resulting in a partition 90 which acts as a structural brace for the traveling bag 10. Preferably, partition 90 is made from a flexible material with high tensile strength. A particularly advantageous feature of the partition 90 is that it includes a zippered flap portion 96 providing access to the rear compartment 92 without having to detach the partition 90 from the body portion 30. Additional structural support is provided to the traveling bag 10 by the support wall 80, the partition 90, and a base plate 110 (see FIG. 4). The support wall 80 may, but need not necessarily, further include a rigid top support plate 84 shown in FIG. 1.

Figure 2:
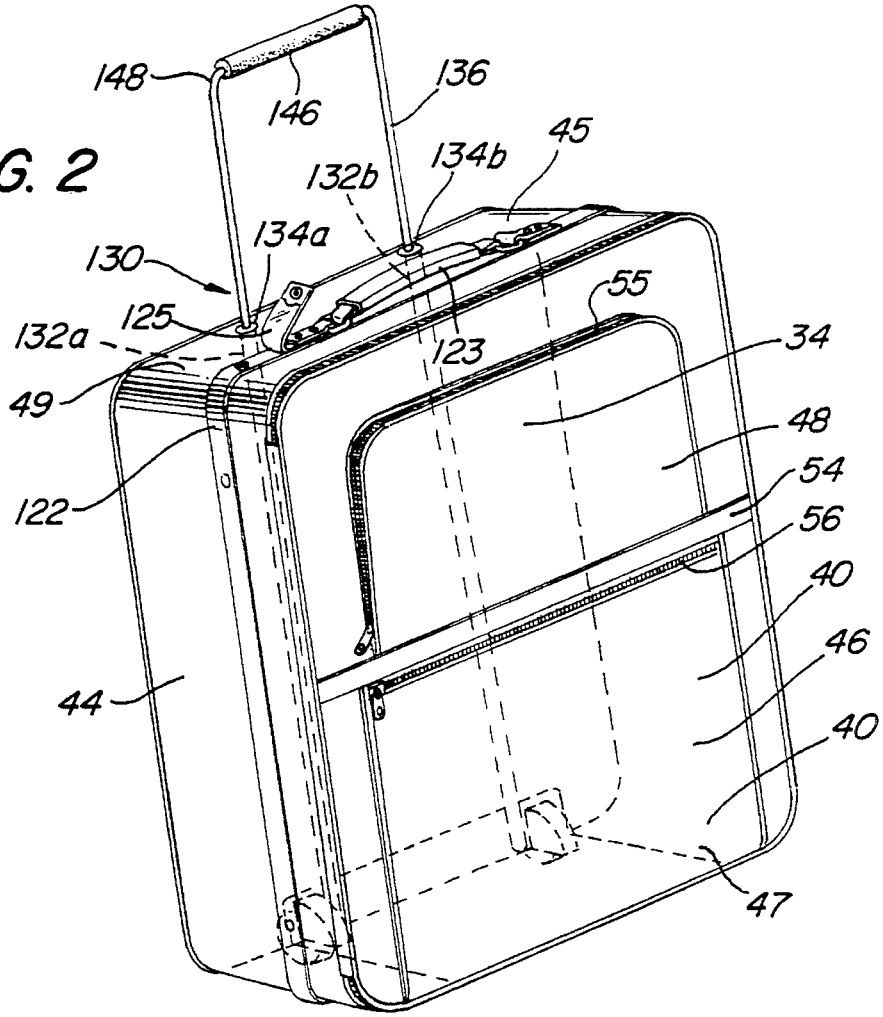
FIG. 2 is a front perspective view of the traveling bag with its extendable handle in an extended position.

As seen in FIG. 2, the body portion 30 includes a back wall 34 and an adjoining perimeter wall 40 which is defined by a perimeter wall interior surface 48 and a perimeter wall exterior surface 49. The perimeter wall interior surface 48 further includes a left side 44, a top side 45, a right side 46, and a bottom side 47. The perimeter wall 40 of the external covering 20 fits around the support wall 80, the partition 90, the top support plate 84 (if included), and the base plate 110. More specifically, the base plate 110 is fit into the exterior covering 20 and attached to the bottom side 47 of the perimeter wall 40. Similarly, the support wall 80 is fit into the exterior covering 20 and attached to the left side 44, the top side 45, and the right side 46. If the top support plate 84 is included in the support wall 80, it is attached to the top side 45 of the perimeter wall 40.

As illustrated in FIG. 1, the perimeter wall 40 of the body portion 30 further includes a hinge edge 41 and a plurality of zippered edges 42*a*, 42*b*, 42*c*. In a closed configuration shown in FIG. 2, a plurality of zippered edges 52*a*, 52*b*, 52*c* of the lid portion 50 are respectively attached to the zippered edges 42*a*, 42*b*, 42*c* of the body portion 30.

A traveler first packs the rear compartment 92 of the traveling bag 10 with items (gym clothes, undergarments, toiletries, sharp objects, etc.) that are preferably segregated from expensive or delicate garments which are easily wrinkled or damaged. The rear compartment 92 is adjacent to the back wall 34 and, more specifically, is defined or bound by the back wall 34, the support wall 80, and the partition 90. The zippered flap portion 96 may be closed to secure the above-described items within the rear compartment 92. Alternatively, the zippered flap portion 96 may be left open, resulting in a single large volume for packing personal articles (namely, the traveling bag compartment 32). If the zippered flap portion 96 is closed, any garments in the front compartment 94 are protected by the partition 90 from any potential damage caused by movement of articles stored in the rear compartment 92. When the traveling bag 10 is in its closed configuration, the front compartment 94 is adjacent to the lid portion 50. More specifically, the front compartment 94 is defined or bound by the partition 90, the support wall 80, and the lid portion 50.

In a preferred embodiment shown in FIG. 1, the traveling bag 10 includes a hanger latch 86 which is attached to the support wall 40 (or to the top support plate 84, if included) at the top of the front compartment 94. A traveler who wishes to pack his or her easily-damaged garments into the front compartment 94 and separate such garments from other personal items contained within the rear compartment 92 need simply close the zippered flap portion 96, thereby spanning the partition 90 across the traveling bag compartment 32. Garments hung upon conventional clothes hangers may then be secured within the hanger latch 86. The traveling bag 10 further includes a plurality of garment straps 87*a*, 87*b* positioned to hold suits and the like in an upright position within the front compartment 94.

The hangar latch 86 may alternatively be attached to the support wall 40 at the top of the rear compartment 92. Hence, a traveling bag 10 is contemplated wherein the front compartment 94 and/or the rear compartment 92 include(s) a hanger latch.

Figure 3:
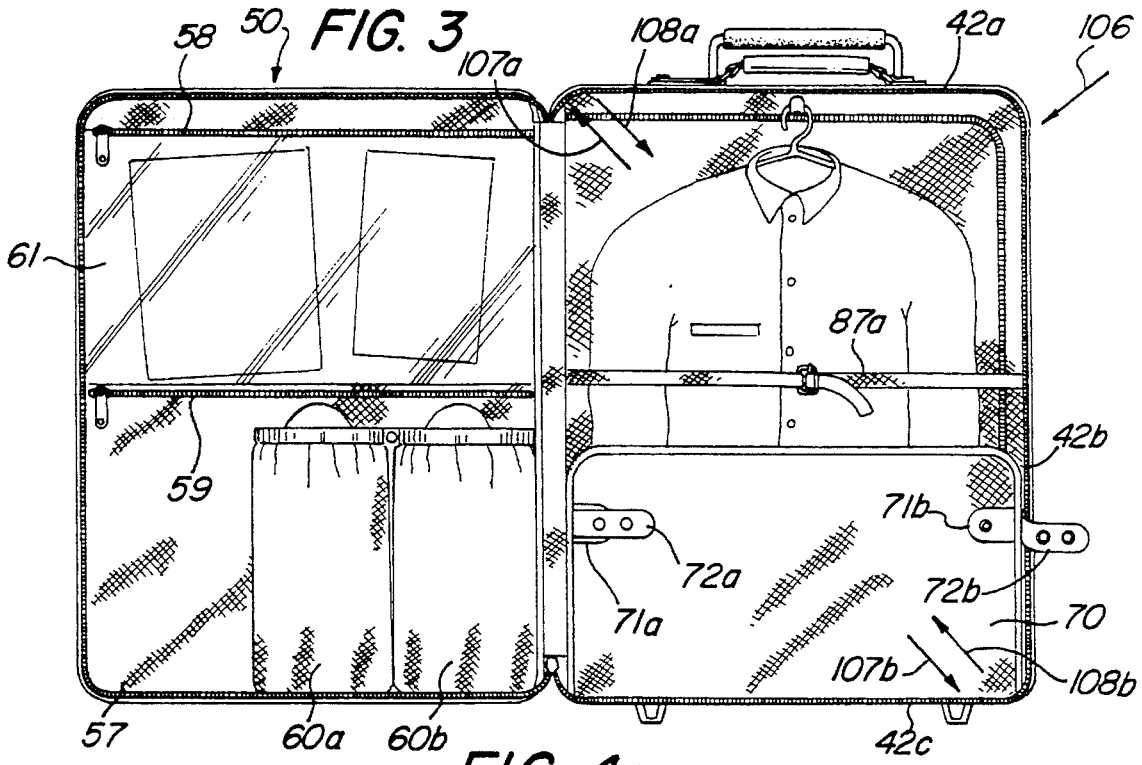
FIG. 3 is a front view of the traveling bag in an open position with garments hanging in the bag's front compartment.

The lid portion 50 is defined by an outside surface 54 (FIG. 2) and an inside surface 57 (FIG. 3). The lid portion 50 further includes a rear pocket 55 and a front pocket 56 which are accessible from the outside surface 54. The rear pocket 55 is preferably zippered and extends, beneath the outside surface 54, across most or all of the lid portion 50. Similarly, the front pocket 56 is zippered and extends, between the rear pocket 55 and the outside surface 54, across part of the lid portion 50. The rear pocket 55 and the front pocket 56 provide the traveler with the convenience of being able to access important personal items without having to open the traveling bag 10, i.e., without having to separate zippered edges 42*a*, 42*b*, 42*c* from zippered edges 52*a*, 52*b*, 52*c*.

As seen in FIG. 3, the inside surface 57 of the lid portion 50 may also include a number of zippered pockets, pouches, and the like. In a preferred embodiment, the lid portion 50 further includes an upper pocket 58, a lower pocket 59, and shoe pouches 60*a*, 60*b* which are accessible, when the traveling bag 10 is in its open configuration, from the inside surface 57. The upper pocket 58 is preferably zippered and comprises, in part, a transparent portion 61 of the inside surface 57. Hence, articles (e.g., maps, important papers, etc.) stored within the upper pocket 58 are visible therethrough when the traveling bag 10 is in its opened configuration. Preferably, the lower pocket 59 is also zippered and extends across a portion of the inside surface 57 not included as part of the upper pocket 58. Shoes pouches 60*a*, 60*b* are attached to the outside of the lower pocket 59 for receiving and securing a pair of shoes.

The external covering 20 may, but need not necessarily, further include a gate portion 70 which is attached to the bottom side 47 of the perimeter wall 40 adjacent to the zippered edge 42*c*. After the garments are secured within the hanger latch 86 and strapped into the front compartment with the garment straps 87*a*, 87*b*, the garments are further secured by snapping the gate portion 70 into the upright position illustrated in FIG. 3. The gate portion 70 includes snaps 71*a*, 71*b* which are attached on opposing ends thereof. The body portion 30 includes fastening devices 72*a*, 72*b* which are, respectively, attached to the left side 44 and the right side 46 of the perimeter wall 40. FIG. 3 shows snap 71*a* attached to fastening device 72*a*.

Figure 4A:
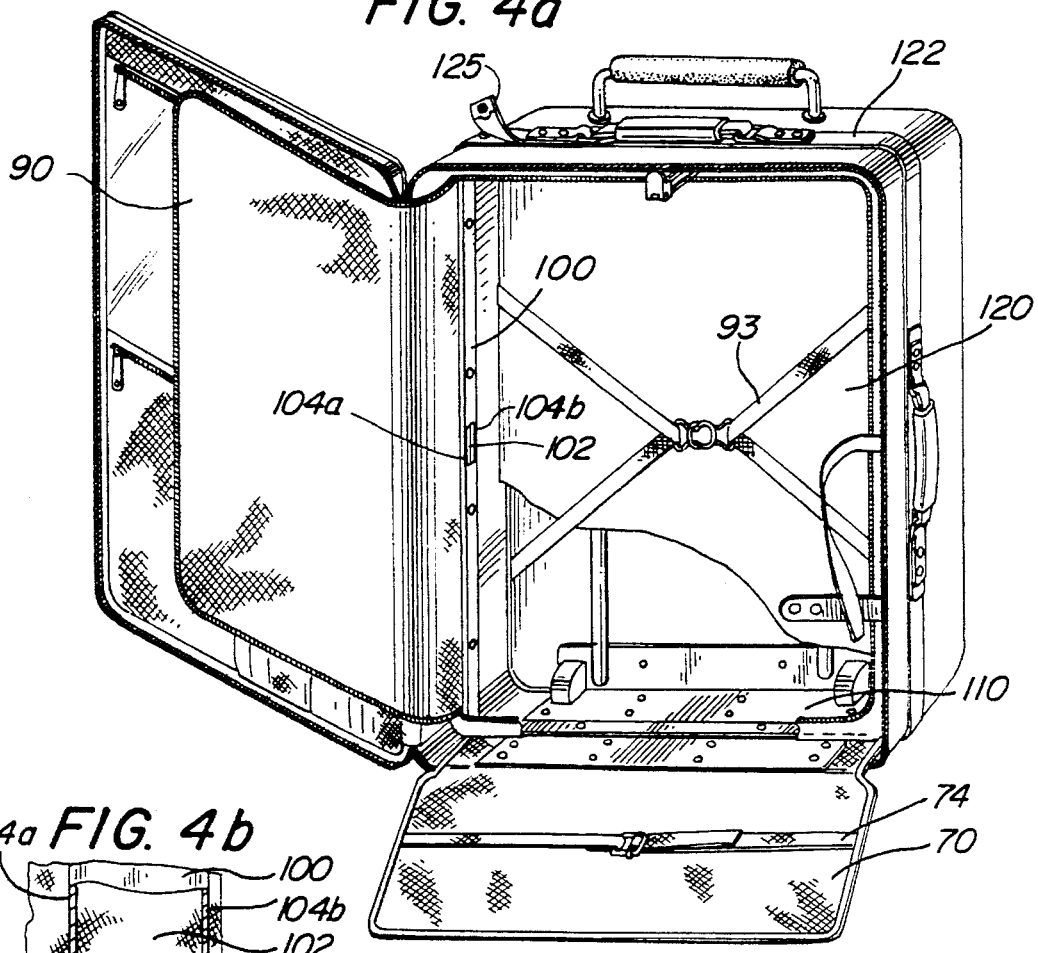
FIG. 4*a* is a front perspective view of the traveling bag including a partial cross-sectional view of the bag's base plate.
Figure 4B:
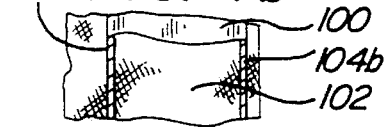
FIG. 4*b* is a partial view of the support band.

An additional feature of the gate portion 70 is its garment strap 74 shown in FIG. 4*a*. Full-length garments, such as dresses or coats, may be further secured by securing their lower portions between the gate portion 70 and the garment strap 74 before the gate portion 70 is snapped into its upright position. As can be readily appreciated, garments stored within the front compartment 94 are safely fastened therein by the respective and combined structural features of the gate portion 70, the garment strap 74, the support wall 80, the top support plate 84, the hanger latch 86, the partition 90, and the base plate 110.

The perimeter support band 100 illustrated in FIG. 4*a* provides additional structural support to and is integral in the assembly of the traveling bag 10. Stated otherwise, the perimeter support band 100 fits within the traveling bag compartment 32 and provides support to the perimeter wall 40. As shown in the enlarged FIG. 4*b*, the band 100 is preferably made of a rigid plastic material 102 including two parallel rigid metallic members 104*a*, 104*b*. A principal advantage of the traveling bag 10 is that its perimeter support band 100, in addition to providing structural support for the perimeter wall 40, secures the partition 90 tautly across the traveling bag compartment 32. More specifically, the partition 90 is secured within the body portion 30 between the support wall 40 and the perimeter support band 100 at the left side 44 and the right side 46 of the perimeter wall 40. At the top side 45, the partition 90 is secured between the top support plate 84 and the perimeter support band 100. At the bottom side 47, the partition 90 is secured between the base plate 110 and the perimeter support band 100.

Partition 90 provides structural support to the partitionable traveling bag 10, thereby protecting easily-damaged garments stored in the front compartment 94 from compressive forces exerted upon the traveling bag 10. The tautly drawn partition 90 prevents compression of the traveling bag 10 when a compressive force is applied to a corner of the traveling bag 10. For example, and as illustrated in FIG. 3, a compressive force 106 applied to the corner of the body portion 30 necessarily results in expansive forces 107*a*, 107*b* being applied to the support wall 80. The partition 90, by virtue of its high tensile strength and its taut partitioning of the traveling bag compartment 32, prevents an expansion of the traveling bag 10. In response to the expansive forces 107*a*, 107*b*, the partition 90 creates retractive forces 108*a*, 108*b* which counteract any diagonal expansion of the traveling bag 10 resulting from the compressive force 106.

The high tensile strength of the partition 90 also protects garments in the front compartment 94 from being damaged by items in the rear compartment 92 when the traveling bag 10 is rotated such that the outside surface 54 of the lid portion 50 faces downward.

The traveling bag 10 further includes an extendable handle assembly 130 (FIG. 2) attached to the base plate 110. The extendable handle assembly 130 extends through the rear compartment 92 traversing the body portion 30 through the top side 45 of the perimeter wall 40. In a preferred embodiment, the handle assembly 130 includes two receiving tubes 132*a*, 132*b*, two rubber grommets 134*a*, 134*b* for securing the two receiving tubes 132*a*, 132*b* to the perimeter wall 40, and a U-shaped member 136 slidably fitting into the two receiving tubes 132*a*, 132*b*. The two rubber grommets 134*a*, 134*b* are positioned on the top side 45 adjacent to the back wall 34 so that the amount of storage space lost in the rear compartment 92 is minimized. The above-described grommet placement necessarily results in additional structural support for the traveling bag 10 via the two receiving tubes 132*a*, 132*b* which are preferably made from a rigid metallic material which can be bolted, welded, or otherwise attached to the base plate.

As seen in FIG. 4*a*, the articles stored in the rear compartment 92 are shielded from the extendable handle assembly 130 by a thin, lightweight back wall 120 which may be glued or otherwise attached to the extendable handle assembly 130. The traveling bag 10 further includes a luggage net 93, preferably attached to the back wall 34, to prevent articles within the rear compartment 92 from moving thereabout. The traveling bag 10 is assembled follows.

Figure 5:
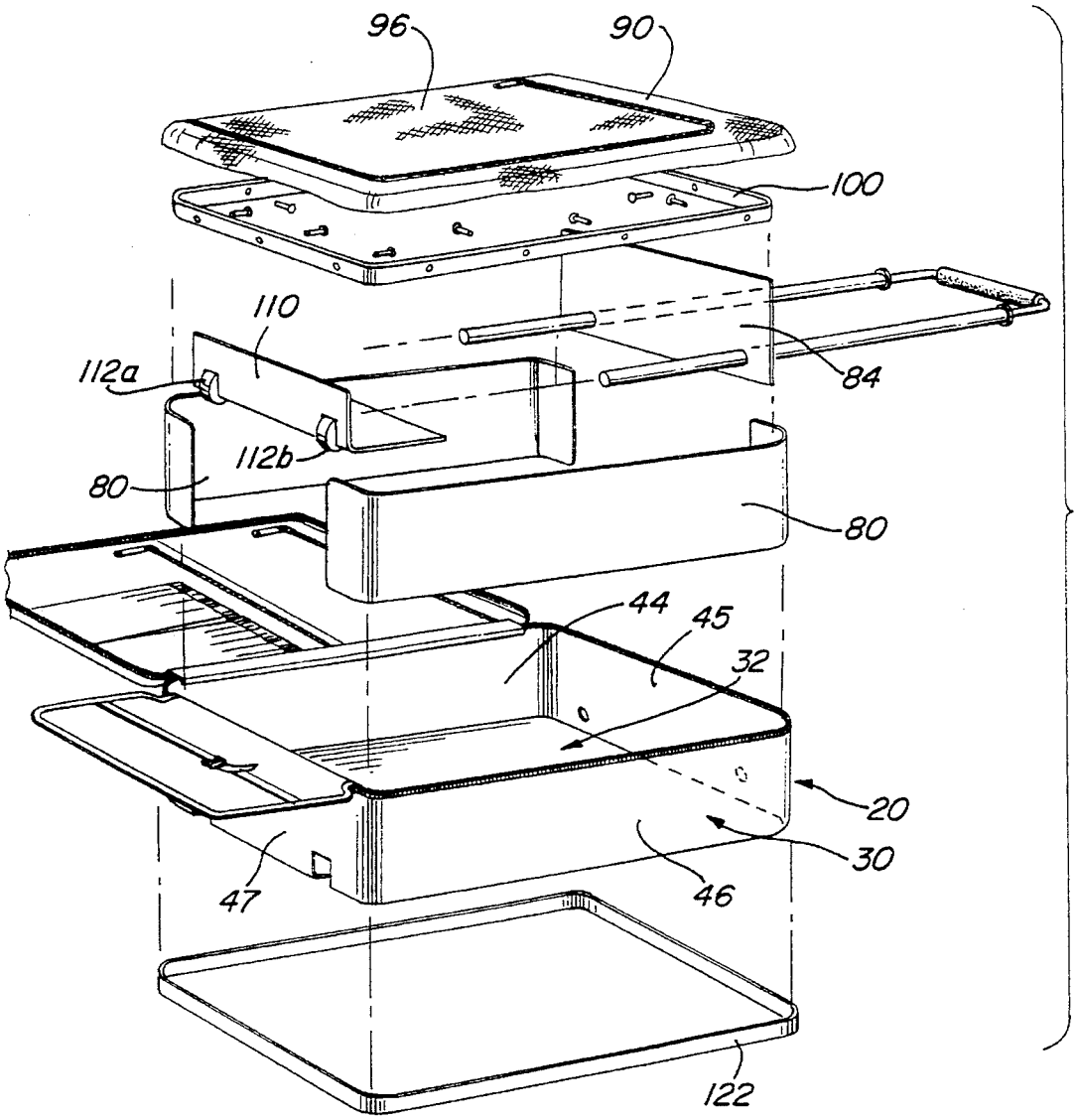
FIG. 5 is an exploded view of the traveling bag.

FIG. 5 is an exploded view of the traveling bag 10 as it appears prior to assembly. Two wheel assemblies 112*a*, 112*b* are attached to the underside of the base plate 110. The support wall 80 is next attached to opposing ends of the base plate 110. The top support plate 84, if included, is attached at its opposing ends to the support wall 80. Thereafter, the entire assembly of base plate 110, support wall 80, and top support plate 84 is fitted into the body portion 30 of the exterior covering 20.

The partition 90 (with its zippered flap portion 96 closed) is then stretched over the perimeter support band 100 so that partition 90 and band 100 may together be fitted into the traveling bag compartment 32. The perimeter support band 100 holds the tautly-drawn partition 90 in place across the traveling bag compartment 32, thereby partitioning the traveling bag compartment 32 into the rear compartment 92 and the front compartment 94. In a preferred embodiment, the partition is secured between the support wall 80 and the perimeter support band 100 on the left side 44 and the right side 46. Similarly, the partition 90 is secured between the top support plate 84 and the perimeter support band 100 on the top side 45 and between the base plate 110 and the perimeter support band 100 on the bottom side 47. Thereafter, the perimeter support band 100 is riveted, bolted, or otherwise secured into place around the perimeter wall 40, thereby stretching the partition 90 across the traveling bag compartment 32. A decorative strip 122 may be added around the outside of the body portion 30 to conceal the rivets or bolts from view.

Figure 6:
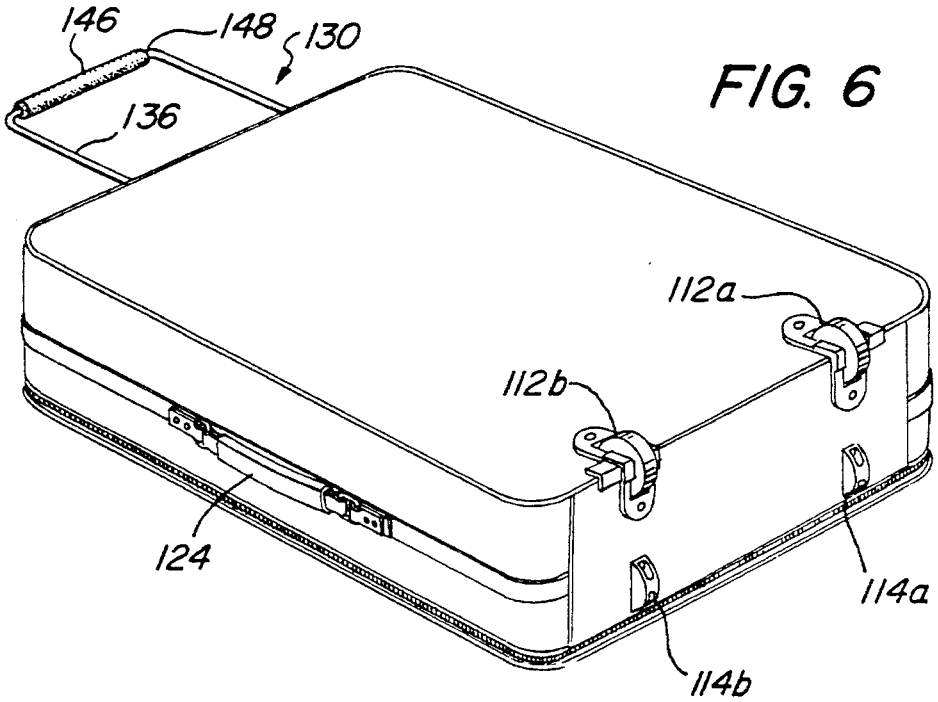
FIG. 6 is a rear perspective view of the traveling bag in a closed position.

Additional features may be added to the traveling bag 10. The structural support inherent in the design of the traveling bag 10 permits the addition of top handle 123 and side handle 124 which are, respectively shown in FIG. 2 and FIG. 6. Preferably, the top handle 123 and side handle 124 are attached to the body portion 30 along the decorative strip 122. An identification tag receptacle 125 (FIG. 2 and FIG. 4*a*) may also be positioned along the decorative strip 122 or elsewhere on the traveling bag 10. Lastly, FIG. 6 shows that the traveling bag 10 may also include feet 114*a*, 114*b* attached to the outside of the bottom side 47 for added stability when the traveling bag 10 is stood in an upright position.

Figure 7:
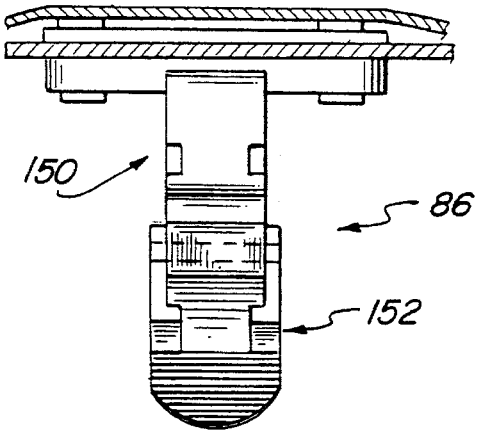
FIG. 7 is a front view of the hanger latch attached above the traveling bag's front compartment.
Figure 8:
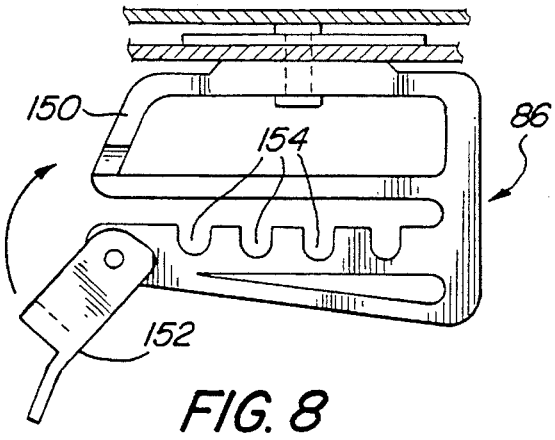
FIG. 8 is a side view of the hanger latch in FIG. 7.

FIG. 7 is a front view of the hanger latch 86 in its opened position. The hanger latch 86 preferably is made of a lightweight yet sturdy plastic material and includes a hanger receiving base portion 150 which is bolted or otherwise attached to the top support plate 84 at the top of the front compartment 94. A pivotable member 152 is attached to the base portion 150 and pivots to a closed position to secure conventional clothes hangers within the base portion 150. FIG. 8 better illustrates, by showing a side view of the hanger latch 86, a plurality of notches 154 included within the base portion 150 for receiving clothes hangers.

Figure 9:
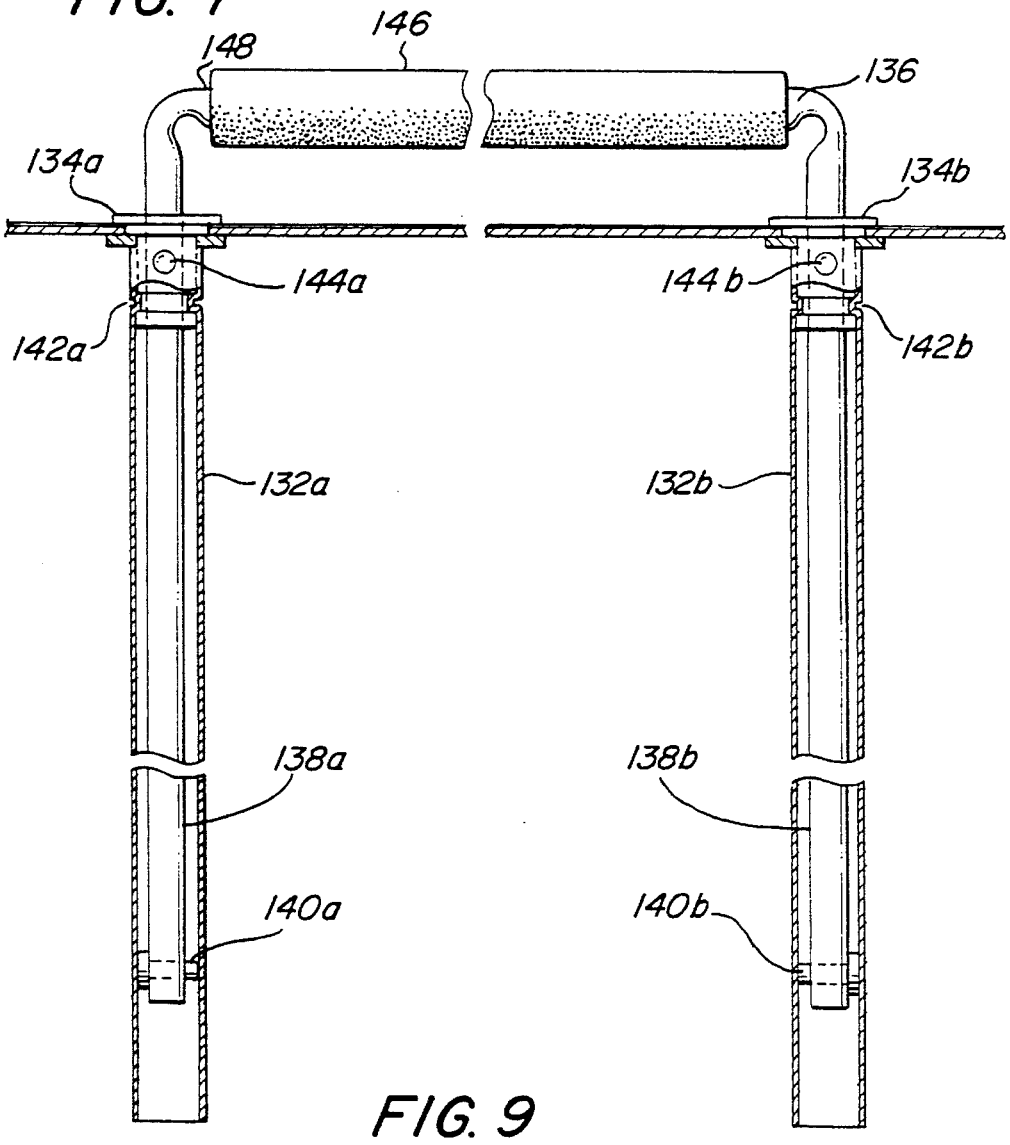
FIG. 9 is a partial cross-sectional view of the traveling bag's extendable handle assembly.

FIG. 9 shows the extendable handle assembly 130 in greater detail. The U-shaped member 136 includes two insertion tubes 138*a*, 138*b* which, respectively, fit into the two receiving tubes 132*a*, 132*b*. Rubber pegs 140*a*, 140*b* are fit into holes drilled through the respective ends of the insertion tubes 138*a*, 138*b*. The pegs 140*a*, 140*b*, which are preferably "nail-shaped," provide resistance to the sliding movement of the U-shaped member 136 within the two receiving tubes 132*a*, 132*b*. Hence, the traveler may extend the U-shaped member 136 as desired so that he or she can pull the traveling bag 10 in comfort while maintaining the selected telescopic extension of the U-shaped member 136.

The two receiving tubes 132*a*, 132*b* also include circumferential crimps 142*a*, 142*b* to prevent the U-shaped member 136 from sliding out of the receiving tubes 132*a*, 132*b*. The circumferential crimps 142*a*, 142*b*, which are applied to the receiving tubes 132*a*, 132*b* after the U-shaped member 136 is inserted therein, sufficiently narrow the effective inner diameter of the receiving tubes 132*a*, 132*b* to prevent the rubber pegs 140*a*, 140*b* from sliding out of the receiving tubes 132*a*, 132*b*. Similarly, the rubber grommets 134*a*, 134*b* are prevented from sliding out of the receiving tubes 132*a*, 132*b* by two depressions or fossa 144*a*, 144*b*. The extendable handle assembly 130 may also include security washers around the two receiving tubes 132*a*, 132*b* and proximate to the rubber grommets 134*a*, 134*b*. The wheel assemblies 112*a*, 112*b* permit the traveler to pull the traveling bag 10 in a backwardly tilted position (FIG. 2) while gripping a foam padding 146 which covers a grip portion 148 of the U-shaped member 136.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A partitioned traveling bag with extendable handle for efficiently packing and transporting garments along with other personal items, the partitioned traveling bag comprising:

a base plate;

at least two wheel assemblies attached to the base plate;

a support wall attached to the base plate for extending on at least two sides of the bag;

an external covering including a body portion and a lid portion, the body portion including a back wall and a perimeter wall adjoining the back wall, the perimeter wall fitting around the support wall and the base plate except for the at least two wheel assemblies which traverse the perimeter wall, a traveling bag compartment being collectively defined by the back wall, the perimeter wall, the support wall, and the lid portion;

a perimeter support band fitting within the traveling bag compartment and providing support to the perimeter wall and support wall;

a partition for partitioning the traveling bag compartment into a rear compartment adjacent to the back wall and a front compartment adjacent to the lid portion, the partition being secured within the body portion adjacent the support wall and the perimeter support band, the partition spanning across the traveling bag compartment and providing structural support to the partitioned traveling bag, the partition including a zippered flap portion providing access to the rear compartment without detaching the partition from the body portion; and an extendable handle assembly attached to the base plate, the extendable handle assembly extending through the rear compartment and traversing the body portion through the perimeter wall.

2. The traveling bag of claim 1 wherein the external covering is made from a flexible polytex material.

3. The traveling bag of claim 1 wherein the support wall is made from a semirigid plastic material.

4. The traveling bag of claim 1 wherein the perimeter support band is made from a rigid plastic material.

5. The traveling bag of claim 1 wherein the perimeter support band includes a rigid metallic member.

6. The traveling bag of claim 1 further comprising a means for securing clothes hangers within the front compartment.

7. The traveling bag of claim 1 further includes a gate portion for securing the garments within the front compartment.

8. The traveling bag of claim 1 wherein the lid portion comprises an outside surface and an inside surface.

9. The traveling bag of claim 8 wherein the lid portion further includes a plurality of pockets attached to the outside surface and the inside surface.

10. The traveling bag of claim 1 wherein the extendable handle assembly comprises:

two receiving tubes attached to the base plate and extending through the rear compartment to the perimeter wall;

two rubber grommets for securing the two receiving tubes to the perimeter wall; and a U-shaped member slidably fitting into the two receiving tubes.

11. A partitioned traveling bag with extendable handle for efficiently packing and transporting garments along with other personal items, the partitioned traveling bag comprising:

a base plate;

at least two wheel assemblies attached to the base plate;

a support wall attached to opposing ends of the base plate for extending on at least two sides of the bag;

an external covering including a body portion and a lid portion, the body portion including a back wall and a perimeter wall adjoining the back wall, the perimeter wall including a left side, a top side, a right side, and a bottom side, the perimeter wall fitting around the support wall and the base plate except for the at least two wheel assemblies which traverse the bottom side of the perimeter wall, a traveling bag compartment being collectively defined by the back wall, the perimeter wall, the support wall, and the lid portion;

a perimeter support band fitting within the traveling bag compartment and providing support to the perimeter wall and support wall, the base plate being positioned between the bottom side of the perimeter wall and the perimeter support band, the support wall being positioned between the left, top, and right sides of the perimeter wall and the perimeter support band;

a partition for partitioning the traveling bag compartment into a rear compartment defined by the back wall, the support wall, and the partition, and a front compartment defined by the partition, the support wall, and the lid portion, the partition being secured within the body portion between the support wall and the perimeter support band, the partition spanning across the traveling bag compartment and providing structural support to the partitioned traveling bag, the partition including a zippered flap portion providing access to the rear compartment without detaching the partition from the body portion; and an extendable handle assembly attached to the base plate, the extendable handle assembly extending through the rear compartment and traversing the body portion through the top side of the perimeter wall.

12. The traveling bag of claim 11 further comprising a means for securing clothes hangers within the front compartment.

13. The traveling bag of claim 11, further includes a gate portion for securing the garments within the front compartment.

14. The traveling bag of claim 11 wherein the extendable handle assembly comprises:

two receiving tubes attached to the base plate and extending through the rear compartment to the perimeter wall;

two rubber grommets for securing the two receiving tubes to the perimeter wall; and a U-shaped member slidably fitting into the two receiving tubes.

15. The traveling bag of claim 11 wherein the support wall further includes a rigid top support plate adjacent to the top side of the perimeter wall, and wherein the traveling bag further comprises a means for securing clothes hangers within the front compartment, the clothes hanger securing means being attached to the rigid top support plate.

* * * * *